US007678263B2

(12) United States Patent
Mock

(10) Patent No.: US 7,678,263 B2
(45) Date of Patent: Mar. 16, 2010

(54) GAS STRIPPING PROCESS FOR REMOVAL OF SULFUR-CONTAINING COMPONENTS FROM CRUDE OIL

(75) Inventor: Jon M. Mock, Katy, TX (US)

(73) Assignee: ConocoPhillips Company, Houston, TX (US)

( * ) Notice: Subject to any disclaimer, the term of this patent is extended or adjusted under 35 U.S.C. 154(b) by 251 days.

(21) Appl. No.: 11/342,742

(22) Filed: Jan. 30, 2006

(65) Prior Publication Data

US 2007/0175796 A1 Aug. 2, 2007

(51) Int. Cl.
*C10G 45/00* (2006.01)
*C10G 17/00* (2006.01)

(52) U.S. Cl. ..... 208/208 R; 208/209; 208/211; 208/212; 208/213; 208/236; 422/231

(58) Field of Classification Search ..... 208/208 R, 208/236, 209, 211, 212, 213; 422/231
See application file for complete search history.

(56) References Cited

U.S. PATENT DOCUMENTS

| | | | | |
|---|---|---|---|---|
| 2,208,505 | A | 7/1940 | Blair et al. | |
| 2,315,843 | A * | 4/1943 | Drennan et al. | 208/208 R |
| 2,549,053 | A | 4/1951 | Brown | |
| 2,592,523 | A * | 4/1952 | Ayers et al. | 208/236 |
| 2,862,878 | A | 12/1958 | Ten Have et al. | |
| 3,244,618 | A | 4/1966 | Diamond et al. | |
| 3,340,184 | A | 9/1967 | Eng et al. | |
| 3,666,659 | A | 5/1972 | Carlson et al. | |
| 3,788,976 | A | 1/1974 | Kirk, Jr. et al. | |
| 4,414,004 | A | 11/1983 | Wagner et al. | |
| 5,252,198 | A * | 10/1993 | Harrison et al. | 208/208 R |
| 6,736,962 | B1 | 5/2004 | Cook et al. | |
| 6,787,025 | B2 | 9/2004 | Mukherjee et al. | |
| 2003/0188992 | A1 | 10/2003 | Halbert et al. | |
| 2005/0238556 | A1 | 10/2005 | Pakulski et al. | |

FOREIGN PATENT DOCUMENTS

| | | | |
|---|---|---|---|
| WO | WO 02/34863 | A1 | 5/2002 |

OTHER PUBLICATIONS

Merichem Co., "Treating", Hydrocarbon Processing, Nov. 1996, p. 144.

(Continued)

*Primary Examiner*—In Suk Bullock
*Assistant Examiner*—Prem C. Singh

(57) ABSTRACT

High rate gas stripping for removal of sulfur-containing components such as mercaptans from crude oil may be conducted by feeding sweet gas to the bottom of a tower containing pre-heated mercaptan-containing crude oil feed. The gas bubbles up through the crude becoming enriched with $H_2S$, mercaptans, $CO_2$ and/or hydrocarbons. The rich gas exits the tower, and is treated to produce a sweetened gas, a portion of which is recycled to the tower, and an acid gas. The remainder of the sweetened and/or the acid gas may be used as a fuel or processed to recover a portion of any hydrocarbons that may have been stripped out of the crude oil with the mercaptans, sulfur-containing components, $CO_2$, used for enhanced oil recovery or disposed.

17 Claims, 3 Drawing Sheets

OTHER PUBLICATIONS

J. C. Bourdon, "Improve Operations and Enhance Refinery Sulfur Recovery," Hydrocarbon Processing, Apr. 1997, pp. 57-62.

EPA Office of Compliance, Profile of the Organic Chemical Industry, 2nd Edition, Nov. 2002, pp. 1, 61-62.

Newpoint Gas Services [Internet]. "H2S and Hydrogen Sulfide Removal from Natural Gas with Amine", [cited Aug. 4, 2005]. Available from: http://www.newpointgas.com/amine%20index.htm.

* cited by examiner

GAS STRIPPING PROCESS FOR REMOVAL OF SULFUR-CONTAINING COMPONENTS FROM CRUDE OIL

TECHNICAL FIELD

The present invention relates to apparatus and methods for removing sulfur-containing components from hydrocarbon streams. More particularly, this invention relates, in one embodiment, to methods and apparatus for stripping light mercaptans from crude oil.

BACKGROUND

Pipeline specifications for crude oil quality strictly limit the amount of certain sulfur containing components, such as mercaptans. Conventional sweetening treatments such as amine treating, caustic solution treatment, and proprietary processes, such as Merichem Company's NAPFINING$^{SM}$, Exxon Mobil's SCANfining$^{SM}$, and the like are known to those skilled in the art. Some of the known proprietary processes use specialty solvents such as SELEXOL®, available from Union Carbide Corporation and licensed by UOP. These processes generally fall into two categories, extractive and non-extractive. Extractive processes generally use a solvent to remove sulfur-containing components, mercaptans for example, from the crude oil. The extracted mercaptans generally are reacted to form disulfides following removal from the crude oil. Non-extractive processes generally convert the mercaptans to disulfide oils which remain mixed with the crude oil. Correspondingly, hydrogen sulfide may be converted to sulfur. Disulfide oils which remain mixed with the crude oil affect the crude oil's value and hinders refining operations due to the additional, more complex processes needed to remove the disulfides from the resulting product streams. Crude oil containing disulfides also increase hydrogen requirements for refining and require more expensive metallurgy. Both extractive and non-extractive mercaptan removal processes are also used to remove sulfur and sulfur-containing species such as hydrogen sulfide and other organic sulfides, e.g., disulfides and thiophenes.

In remote production and hydrocarbon processing sites, infrastructure such as roads, railways and electrical supplies are not readily available. Thus, it is difficult to transport chemicals such as caustic, amines and specialty solvents to the site and power electrical equipment. Some sites are also located in environmentally sensitive areas such as regions containing permafrost. In these areas, it is undesirable to build additional infrastructure and increase the size of the areas (footprint) used to produce and/or process the hydrocarbons. Reduced use of chemicals save storage and further reduce the facility's footprint, but also increases safety for the environment and personnel. For crude petroleum offshore platforms, weight requirements may also be reduced. Cold climates also have freeze protection issues relating to any pipelines and equipment when using chemicals diluted with water, e.g., caustic solutions. Accordingly, the present invention offers an improvement to these processes. Therefore, the industry has sought a method and apparatus for removing sulfur-containing components from crude oil which reduce the need for infrastructure, reduce the area required for production, reduce the weight on production platforms, reduce potential freezing problems, provide improved safety and that are more environmentally friendly.

SUMMARY

There is provided in one non-restrictive embodiment a method for reducing content of at least one sulfur-containing component, in a hydrocarbon stream that involves stripping the hydrocarbon stream including at least one sulfur-containing component with a gas stream having a relatively reduced level of the sulfur-containing component or no sulfur-containing component. This stripping produces a gas stream containing an increased level of sulfur-containing component(s) and a hydrocarbon stream containing a reduced level of sulfur containing component(s), i.e., S.C.C.

In an alternative non-limiting embodiment there is provided a hydrocarbon processing system for processing crude oil that includes a unit for reducing content of at least one S.C.C. in a crude oil. The unit strips the crude oil including at least one S.C.C. with a gas stream having a relatively reduced level of the S.C.C. or no S.C.C. to give a gas stream containing an increased level of S.C.C. and a crude oil stream containing a reduced level of S.C.C.

In still another non-limiting embodiment, there is provided a method for processing crude oil to selectively strip lighter mercaptans, e.g., methyl mercaptans and ethyl mercaptans.

DETAILED DESCRIPTION

Figure 1:
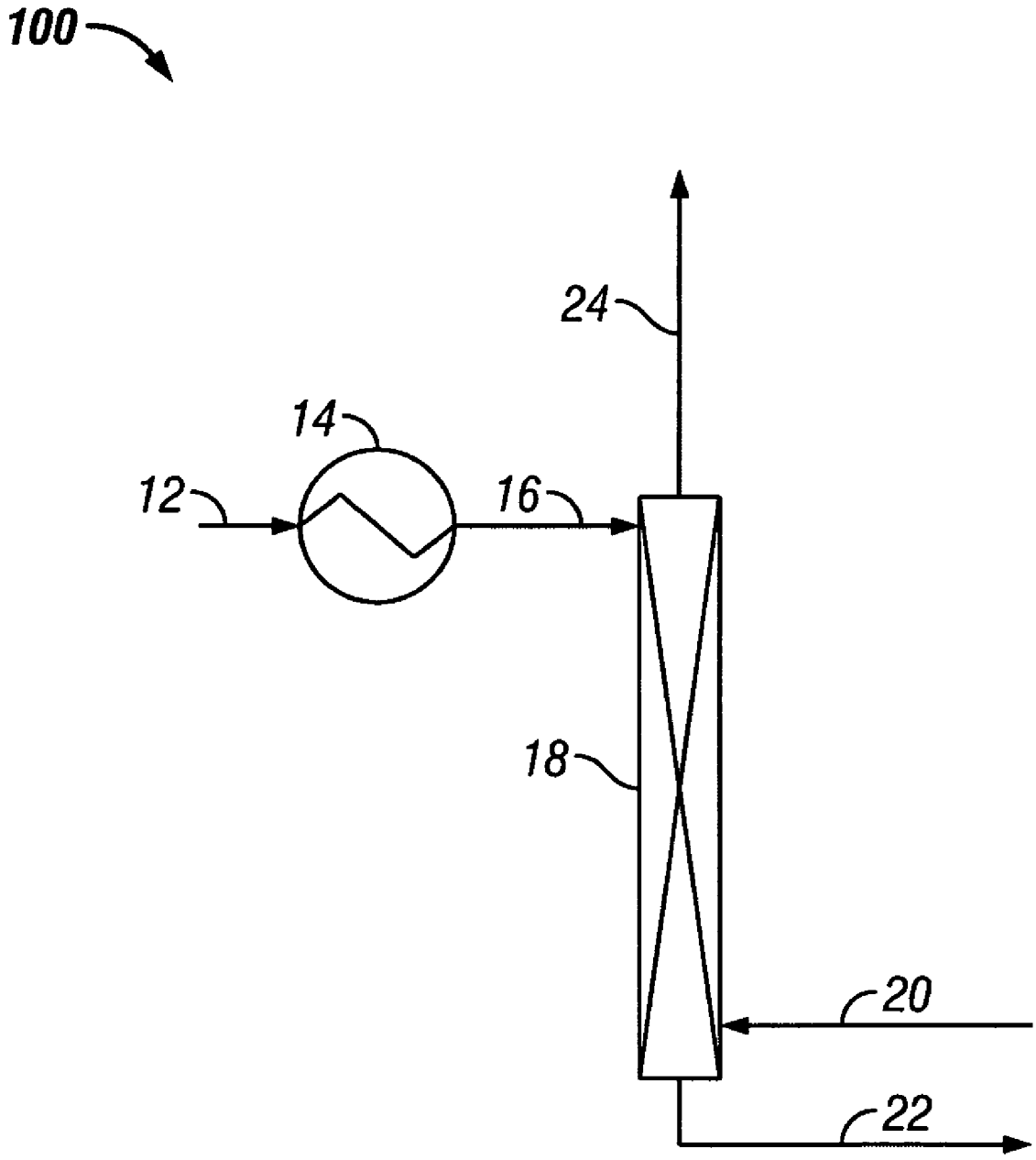
FIG. 1 is a schematic illustration of one non-limiting embodiment of the gas stripping process for removing S.C.C. from a hydrocarbon stream described herein.

It has been discovered that mercaptans, particularly light mercaptans, and other S.C.C. in general, may be removed from hydrocarbon streams, in one non-limiting embodiment crude oil, by stripping the hydrocarbon stream with a gas stream. In another non-restrictive embodiment, what is generally known in the industry as a sweet natural gas stream or a sweet gas stream comprising mostly methane or mixtures of methane, ethane, and small amounts of propanes, butanes and yet smaller amounts of heavier hydrocarbons, in various non-limiting mixtures, may be used for stripping. Generally, crude oil is used as the hydrocarbon stream to be sweetened or desulfurized in discussions herein, but it will be appreciated that the methods and apparatus herein may be usefully employed with other hydrocarbon streams. It will also be appreciated that the method will be considered successful even though all of the S.C.C. are not completely removed from the hydrocarbon stream, but the proportion of S.C.C. therein is reduced. Sweet stripping gas may be fed near the bottom of a tower at a point below the hydrocarbon feed and at a rate sufficient to provide a partial pressure of S.C.C., to extract sufficient amounts of the S.C.C., for example light mercaptans, to meet a specification based upon environmental specifications, downstream operations such as refining or other uses. The stripping gas may be fed at the bottom end of the tower or other location near the bottom end of the tower.

The stripping gas bubbles up through the falling hydrocarbon liquid (e.g. liquid from the crude). While the gas moves up the tower it may become enriched with $H_2S$, COS, mercaptans (particularly light mercaptans) other S.C.C. and hydrocarbons. It will be appreciated that in another non-limiting embodiment herein that the tower may be any vessel which facilitates the gas stripping, for example a spray tower, a distillation tower or a combination thereof.

The crude oil may flow downward through the tower internals, for example, structured packing, random packing, sieve trays, valve trays, or or disk and donut trays, or combinations thereof, becoming leaner in S.C.C., e.g. mercaptan content. Meanwhile, the gas becomes richer in S.C.C. and carbon dioxide content as it bubbles up the tower and exits the tower. The gas rich in S.C.C. may be compressed, cooled and treated to remove S.C.C. and carbon dioxide by contacting with a physical solvent (e.g. SELEXOL®, available from Union Carbide Corporation or SULFINOL®, available from Shell International Petroleum Co., Ltd. or LE-701 amine solvent available from Dow/Union Carbide, among others), a mercaptan-selective amine chemical solvent or a caustic solution in accordance with known techniques. The rich solvent solution may be flashed to lower pressure and regenerated using pressure difference, heat, or a combination of the two. Alternatively, the product acid gas stream may be incinerated; burned for fuel; injected into a reservoir as a gas or as a dissolved gas within a liquid; or processed to recover hydrocarbons that may have been stripped out of the crude oil along with the S.C.C. with known techniques. Acid gas handling may also be by compression for injection into underground reservoirs for enhanced oil recovery or disposal, or by dissolving the acid gas in waste oilfield brines (produced water) or fresh water prior to injection of the water for enhanced oil recovery or disposal.

Distillation, including cryogenic distillation, or other technologies, such as solid bed treating or the like, may be used to separate the S.C.C. from the gas stream, typically after compression. A liquid recovery plant (e.q., gas plant) may be used to recover relatively light hydrocarbons (e.g., $C_1$+) after treating for sulfur compound and carbon dioxide removal, or as described above on the acid gas stream. In the context of the method(s) herein, the use of a solvent to remove the S.C.C., and then regenerating the rich solvent solution may be understood to be a form of distillation. The remaining acid gas may then be handled by any of several technologies described above or also using Claus reactors or direct redox sulfur recovery units, or other known technologies in any non-limiting combinations thereof. Sweetened gas from the top of the absorption tower may be routed back to the crude oil stripping tower for re-use.

Processes such as liquid/liquid contacting or liquid/solid contacting to strip $H_2S$ from crude oil have been used at many locations in the oil industry. Solvent systems to remove $H_2S$ and COS, $CO_2$ and mercaptans are common in the upstream (production) and downstream (refining) sectors. A new aspect of the system and method(s) herein involves using a substantially large gas flow rate to remove or strip S.C.C. from liquid hydrocarbon streams, otherwise known as sweetening. In one non-limiting embodiment, the gas stripping process is combined with selection of a solvent for removal of the mercaptans and possibly other S.C.C. to obtain a low mercaptan and $H_2S$ (sweet) stripping gas. The term "sweet" herein when relating to crude oil or natural gas is defined as lacking appreciable amounts of sulfur or sulfur-containing components, in particular $H_2S$ and light mercaptans. In another non-limiting embodiment, "sweet" may mean containing no or less than 16 grains total sulfur per thousand standard cubic feet of gas (as $H_2S$, COS and light mercaptans), alternatively less than 0.25 grains per thousand standard cubic feet of gas of $H_2S$ (4 ppmv). In crude oil "sweet" may mean less than 40 ppmw of light mercaptan or it may mean less than 0.5 percent total sulfur by weight. Light mercaptans are defined herein as methyl mercaptan ($CH_3SH$) and ethyl mercaptan ($C_2H_5SH$) and the like.

The hydrocarbon streams being stripped in accordance with the methods and systems described herein may be any stream containing hydrocarbons in significant amounts which also contain S.C.C., particularly light mercaptans. The hydrocarbon streams may be crude oils, synthetic crude oils; atmospheric gas oils; fuel oils; diesel oils and the like and combinations thereof in various non-limiting mixtures and embodiments. The hydrocarbon streams may contain other components including, but not necessarily limited to, water, $CO_2$, asphaltenes, acids, naphtha, paraffins, olefins, oxygenated hydrocarbons, oxygen, nitrogen, sulfur, sulfur derivatives, disulfides and aromatics, and the like and combinations thereof.

Suitable gas streams to be used in stripping out light mercaptans from hydrocarbon streams include, but are not necessarily limited to, natural gas, methane, ethane, propane, butane, pentane and heavier hydrocarbons, nitrogen, carbon dioxide, argon, helium, hydrogen, carbon monoxide and the like and combinations thereof. The stripping gas stream may be any gas stream that accomplishes the purposes and/or of the methods herein without containing components that do not appreciably interfere with those purposes and/or methods. It is expected that in some embodiments the stripping gas stream will be predominantly if not entirely in the gas phase.

It will be appreciated that it is difficult if not impossible to specify in advance a particular gas stripping rate for a particular hydrocarbon stream without appreciable information and data. For instance, in one non-limiting embodiment, the gas stripping rate may depend on one or more of the following factors, many of which are interrelated, including, but not necessarily limited to, the composition of the hydrocarbon stream being treated—particularly the S.C.C., and more particularly light mercaptan content; the level of S.C.C. or mercaptan specified in the treated product stream; the volume of the hydrocarbon stream; the relative volatility established for the S.C.C. or mercaptans with respect to the hydrocarbon stream components: the nature and composition of the gas stripping stream: the temperature and pressure of the stripping conditions; and the like. Nevertheless, in order to give some sense of the range of suitable stripping rates, in one non-limiting embodiment the lower and upper limits of the gas stripping rate may be about 0.1 and about 1.0 MSCF per barrel of hydrocarbon, (about 18 and about 180 $m^3$ gas/$m^3$ hydrocarbon stream). Alternatively, the lower and upper limits of the gas stripping rate may be about 0.25 and about 0.5 MSCF per barrel of hydrocarbon (about 44 and about 89 $m^3/m^3$). In another non-restrictive version, the upper and lower limits of the gas stripping rate may be about 0.3 and about 0.4 MSCF per barrel of crude, (about 53 and about 71 $m^3/m^3$).

Stripping tower conditions, the type of tower internals, the liquid and gas distribution within the tower, as well as those of the hydrocarbon feed stream and stripping gas stream are expected to be largely selected based upon mass transfer within the stripping tower; external transport concerns, such as pumping through a pipeline; and the crude composition. Keeping the viscosity of the hydrocarbon feed stream low is expected to be important to assure the stripper functions. In many situations, the crude may be transported by a long pipeline to the stripping tower and by a long pipeline to a loading terminal. Elevated temperature is important to keep the paraffin from dropping out of the pipelines and preventing gel formation in non-paraffin oils and creating problems. It should be understood that the tower operating conditions may be varied over relatively wide ranges. In addition, it should be further understood that the tower or column may be a reboiled column or a fully rectified column having a reboiler and partial condenser. Nevertheless, in order to give some sense of the operating conditions for the methods and systems discussed herein, the lower and upper temperature range limits for the hydrocarbon stream to the stripping tower may be about 0 and about 350° F. (about −18 to about 177° C.). In another non-limiting embodiment, the lower and upper temperature range limits for the hydrocarbon stream to the stripping tower may be about 70 and about 200° F. (about 21 to about 93° C.).

Similarly, the temperature of the stripping gas to the tower may be about 0 and about 350° F. (about −18 to about 177° C.). In another non-limiting embodiment, the lower and upper temperature range limits for the hydrocarbon stream to the stripping tower may be about 70 and about 200° F. (about 21 to about 93° C.), respectively.

Additionally, to give some sense of the pressure and temperature conditions for operating the tower, the lower and upper temperature ranges may be in one non-limiting embodiment about 0° F. and about 350° F. (about −18 to about 177° C.) respectively, and in another non-restrictive version may be about 70° F. and about 200° F. (about 21 to about 93° C.) respectively, and the lower and upper pressure ranges may be in one non-limiting embodiment about 0 psig and about 600 psig (about 0 to about 4.1 MPa) respectively, and in another non-restrictive version may be about 15 psig and about 400 psig (about 0.1 to about 2.8 MPa), respectively.

The systems and methods herein will now be described in more detail with respect to FIG. 1 in which overall gas stripping system 100 generally begins with hydrocarbon feed stream 12 pre-heated in feed heater 14 which is fed to stripper tower 18. Stripping tower 18 may optionally have a reboiler or be a fully rectified column with both a reboiler and partial condenser in order to control the crude oil vapor pressure and to provide energy for the separation of S.C.C. from preheated feed stream 16 or alternatively from hydrocarbon feed stream 12, if not preheated. It must be understood that in addition to organic S.C.C., inorganic S.C.C. such as $H_2S$ in the hydrocarbon feed stream 12 may be removed by the method(s) and apparatus described. The preheated stream 16 is introduced at or near the top of stripping tower 18. Stripping gas, e.g. sweet natural gas, 20 is introduced at or near the bottom of tower 18. Stripping gas 20 is fed at a relatively high rate sufficient to provide a partial pressure of S.C.C. (e.g. methyl and ethyl mercaptans) sufficiently low to produce a stripped hydrocarbon stream 22 having a reduced level of S.C.C. (e.g. methyl and ethyl mercaptans) removed at or near the bottom of tower 18, after flowing downward through the tower internals (not shown) to become leaner in S.C.C. (e.g. methyl and ethyl mercaptans). Although countercurrent contact is described in some embodiments herein, other modes of contact may be suitable including, but not necessarily limited to, cocurrent contact, cross-current contact and combinations of these. Stripped hydrocarbon stream 22 may be sweet crude oil in one particular, non-restrictive embodiment. The stripping gas 20 bubbles up through the liquid hydrocarbon in the tower, becoming enriched with S.C.C., and also $CO_2$ and hydrocarbons, exiting the top of the tower 18 as rich gas stream 24 containing an increased level of S.C.C.

Figure 2:
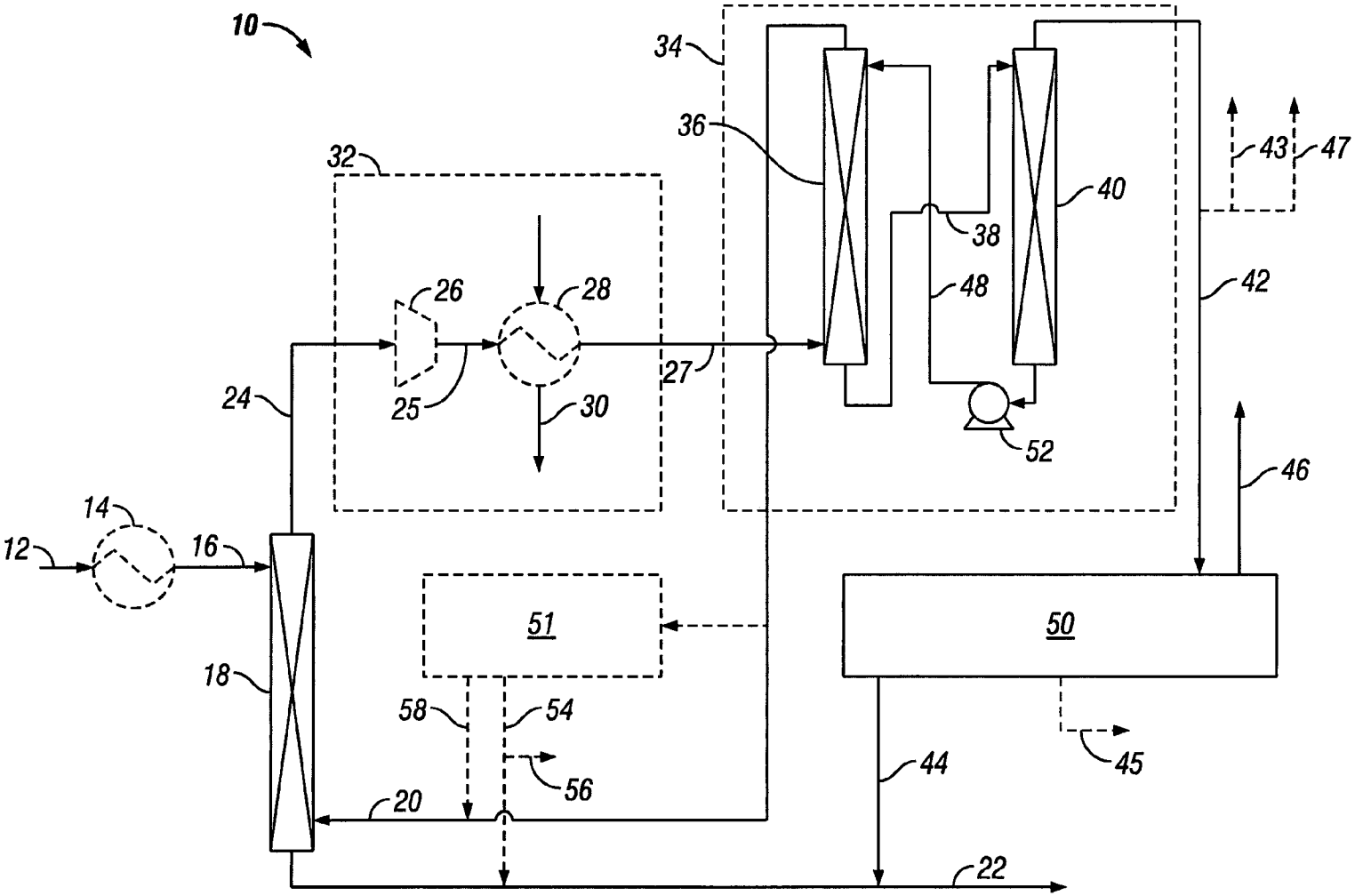
FIG. 2 is a schematic illustration of another non-restrictive embodiment of the gas stripping process for removing S.C.C. from a hydrocarbon stream described herein.

Shown in FIG. 2 is another non-limiting embodiment of the invention, hydrocarbon processing system 10, where the same or similar or equivalent items as those in FIG. 1 are referred to with like reference numerals. Again, hydrocarbon feed stream 12 is pre-heated in feed heater 14 to provide the crude oil vapor pressure and to provide energy prior to the separation of S.C.C. the hydrocarbon feed stream 12. The preheated stream 16 is introduced at or near the top of stripping tower 18, whereas stripping gas 20 is introduced at or near the bottom of tower 18. Stripping gas 20 is fed at a relatively high rate sufficient to provide a partial pressure of S.C.C. sufficiently low in the depleted or stripped hydrocarbon stream 22 having a reduced level of S.C.C. removed at or near the bottom of tower 18, after flowing downward through the tower to become leaner in S.C.C. The stripping gas 20 bubbles up through the liquid hydrocarbon in the tower, becoming enriched with S.C.C., and also $CO_2$ and hydrocarbons, exiting the top of the tower 18 as rich gas stream 24 containing an increased level of S.C.C.

Optionally as shown in FIG. 2, rich gas stream 24 may be compressed by compressor 26, producing compressed stream 25 which may be cooled via heat exchanger 28 by cooling medium 30 in optional gas compression and cooling subsystem 32, resulting in a S.C.C. rich stream 27 which may be contain liquid, gas and mixtures thereof. Stream 27 may then be fed to S.C.C. and $CO_2$ removal subsystem 34. It will be appreciated throughout the drawings that equipment and streams shown in dashed lines is considered optional, to be used in alternative non-limiting embodiments, for instance compressor 26 and heat exchanger 28.

At high pressure tower 36, condensed liquids may be separated from the gas phase and the resulting gas may be contacted with a lean solvent stream 48., The lean solvent stream 48 may be a mercaptan selective or other S.C.C. selective amine chemical solvent or a caustic solution, as previously mentioned, using other known technology. The rich solvent solution 38 may then be separated in low pressure tower 40 into a product acid gas 42 and a lean solvent stream 48. The product acid gas 42 may be fed to a hydrocarbon recovery unit 50 for recovery of valuable hydrocarbons. In an alternate embodiment, the acid gas 42 may be injected in a reservoir for enhanced oil recovery as injection steam 43, incinerated or treated for elemental sulfur removal using known technologies (e.g., a Claus reactor) as treatment stream 47. In another non-limiting embodiment, sulfur removal subsystem 34 may be replaced with a solid bed treatment unit (not shown).

Acid gas 42 may be refrigerated in the hydrocarbon recovery unit 50 to provide recovery of valuable liquid hydrocarbons 44, which may be combined with stripped hydrocarbon stream 22, that may have been initially stripped out in stripping tower 18 or crude oil separation operations (not shown). In an alternate embodiment, hydrocarbon recovery unit 50 may comprise a cryogenic distillation train (not shown) which may be operated in various modes to produce a single valuable gas hydrocarbon stream 45. It will be appreciated that valuable gas hydrocarbon stream 45 may be split into multiple streams (not shown) known in the art as natural gas, ethane, propanes, LPG, butanes and pentanes plus heavier hydrocarbons and sent to storage, to a pipeline or to other uses. It is also known in the art that the recovery split(s) produced by hydrocarbon recovery unit 50 may represent various non-limiting embodiments which may be employed as driven by the economics and the design of the system. Hydrocarbon recovery unit 50 may also use distillation or other technologies (not shown), such as solid bed treating, to produce a second acid gas stream 46 by separating S.C.C. from the recoverable valuable liquid hydrocarbons 44, or in an alternative embodiment, the valuable gas hydrocarbons 45. The design of this unit, as well known in the art, will depend upon the particular S.C.C. removal process and the composition product acid gas 42 composition. The second acid gas stream 46 may go to disposal, use in enhanced oil recovery or elemental sulfur recovery.

In another non-limiting, optional embodiment, a second hydrocarbon recovery unit 51 may be used in addition to or alternatively to hydrocarbon unit 50 to recover valuable liquid hydrocarbons and/or valuable gas hydrocarbons 54 from stripping gas 20. Hydrocarbon recovery unit 51 may be designed and operated like recovery unit 50, with the exception that hydrocarbon recovery unit 51 would not produce a third acid gas stream. As in the case of hydrocarbon recovery unit 50, part or all of hydrocarbon stream 54 may be sent to storage or for other use or combined with depleted or stripped hydrocarbon stream 22, or split as stream 56 into single or multiple streams (not shown) known in the art as natural gas, ethane, propanes, LPG, butanes and pentanes plus heavier hydrocarbons. Alternatively, or in addition thereto, an optional recovered hydrocarbon stream may be used as a supplemental or make up stream 58 to stripping gas stream 20.

Figure 3:
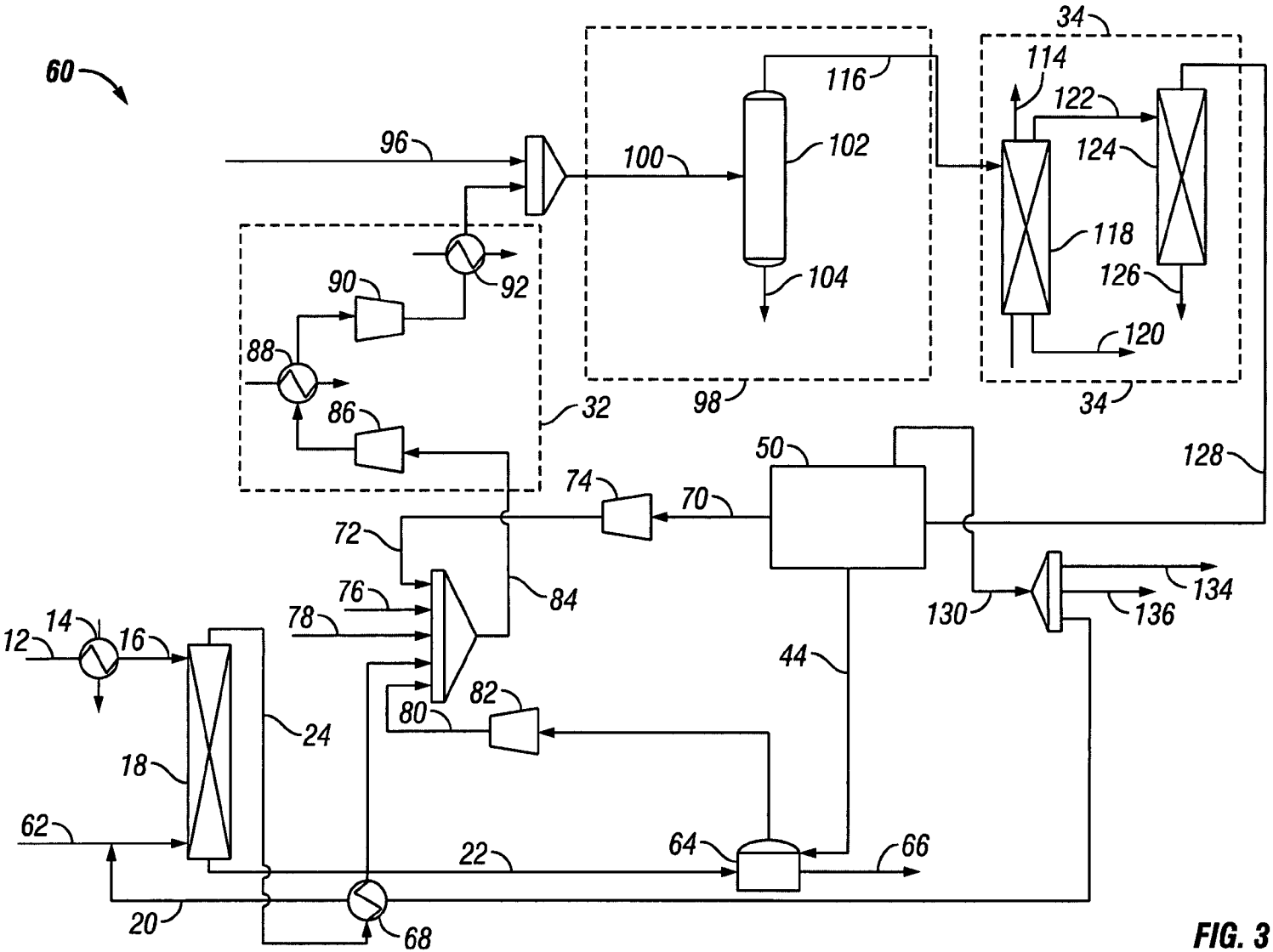
FIG. 3 is a schematic illustration of another non-restrictive embodiment of the gas stripping process for removing S.C.C. from a hydrocarbon stream described herein.

FIG. 3 relates to an alternate embodiment of the system and method herein where equipment and streams that are the same or similar or equivalent to those in FIGS. 1 and 2 are referred to with like reference numerals, where the overall hydrocarbon processing system is referred to as 60. The hydrocarbon feed stream 12 may be pre-heated in feed heater 14 to give preheated stream 16 or introduced without being preheated at or near the top of stripping column 18, where stripping gas 20, e.g. sweet natural gas, is introduced at or near bottom of tower 18, augmented by make-up stripping gas stream 62. Stripped hydrocarbon stream 22, e.g. sweetened crude oil stream, goes to oil storage 64 equipped with a vapor recovery unit (VRU)(not shown), from which is drawn stripped crude oil 66 directed to sales, refining or other use.

Rich gas stream 24 containing S.C.C. (and some non-sulfur containing hydrocarbons and carbon dioxide) is cooled by heat exchanger 68 transferring heat to stripping gas stream 20, before being combined with liquefied petroleum gas (LPG) stream 72 from LPG stabilizer overhead compressor 74, water treating flash gas stream 76, oil separation flash gas stream 78 and vapor stream 80 recovered from oil storage 64 compressed by compressor 82. Mixed gas stream 84 is compressed and cooled in gas compression and cooling subsystem 32 by first stage flash gas compressor 86, heat exchanger 88, second stage flash gas compressor 90, heat exchanger 92 and may be combined with produced gas 96 from primary crude oil separation before going to gas injection section 98 as stream 100.

Stream 100 is generally separated by unit 102 into injection gas stream 104 containing a relatively greater level of S.C.C. and gas stream 116 containing a relatively lower level of S.C.C. that is passed on to sulfur removal subsystem 34. This separation may be conducted by any known technology. As discussed previously, injection gas stream 104 may be compressed for injection into an underground reservoir, such as for enhanced oil recovery and/or disposal, or the stream 104 may be dissolved in produced water (typically waste oilfield brines) or even fresh water prior to injection of the water for enhanced oil recovery or the like.

Additionally, there may be situations where it is desirable to have hydrocarbon recovery unit 51 in sequence before gas injection section 98. In the case where a solvent like propylene carbonate (e.g. Fluor Solvent) is employed, the solvent typically works best when refrigerated. In such a non-limiting embodiment, there may be benefit in including a hydrocarbon recovery unit 50, also in FIG. 2, as well.

Stream 116 from gas injection section 98 goes to S.C.C. and $CO_2$ removal subsystem 34 at gas sweetening contactor 118 to condense acid gas 120 separated from the gas phase which may go on to be contacted with a physical solvent, a mercaptan selective or other S.C.C. selective amine chemical solvent or a caustic solution, as previously mentioned, using known technology or to other disposal. The rich solvent 122 is then introduced to gas dehydration contactor 124 where water 126 is removed and dehydrated gas stream 128 goes to hydrocarbon recovery unit 50 that splits out valuable hydrocarbon stream 44 (e.g. $C_4$+, $C_5$+ or some other valuable split), such as discussed above with respect to FIG. 3 and in another non-limiting embodiment, stream LPG 70. The gas remainder stream 130 is divided between stripping gas stream 20, fuel gas stream 134 and/or export gas stream 136.

The methods and compositions herein will now be further illustrated with more specific Examples, but these Examples are not intended to limit the methods and compositions herein in any respect, but are provided to further show and describe them. It will be appreciated that the Examples are the result of careful simulations, and that no pilot or full scale studies have yet been conducted.

EXAMPLE 1

With respect to gas stripping rates suitable for the methods and systems herein, a number of simulations were performed.

For a crude oil stream of 150,000 BPD (24,000 $m^3$/day), one case simulated used 65 MMSCFD ($1.8\times10^6$ $m^3$/day) sweet natural gas to strip the light mercaptans to 6 ppmw methyl mercaptan and 2 ppmw ethyl mercaptan. Feed concentrations were set at 111 ppmw methyl mercaptan and 237 ppmw ethyl mercaptan. The assumed crude oil feed temperature to the stripping tower was 200° F. (93° C.), and the assumed stripping gas temperature was 150° F. (66° C.). The simulation was completed at 50 psig (0.34 MPa) for the stripping tower.

The temperature and pressure were set primarily by the crude oil vapor pressure that would be required for loading the oil on a tanker. It may be understood that temperature and pressure also plays a role in the simulation in establishing the mass transfer properties for the crude oil. The particular crude used in the simulation herein was very paraffinic. Cloud point was around 90° F. (about 32° C.).

The rates were estimated with user provided or adjusted Kij (relative volatility) data. The HYSYS® process modeling tool software (Aspen Technology, Inc.) denotes these terms as interaction parameters. Using the same gas rate with the original HYSYS® provided or default Kij values resulted in 6 ppmw methyl mercaptan and 35 ppmw ethyl mercaptan; results that were not as promising. In one non-limiting model, stripping gas rates for the $H_2S$ stripping system originally proposed were 65 MMSCFD ($1.8\times10^6$ $m^3$/day). To achieve the 6 and 35 mercaptan ppmw concentrations, respectively, with the revised Kij data, it was possible to lower the stripping gas rate to 43 MMSCFD ($1.2\times10^6$ $m^3$/day). Please see the data summarized in Table I. Thus, one gas stripping range for this particular product specification may be from about 0.25 to about 0.5 MSCF per barrel of crude (about 44.5 to about 89.0 $m^3/m^3$).

TABLE I

Example 1 Simlations

| $K_{ij}$ | P, psig | T, ° F. | Crude Oil Rate | Inlet Mercaptan | Stripping Gas Rate | Outlet Mercaptan |
|---|---|---|---|---|---|---|
| Default | 50 | 200 | 150,000 | 111 ppmw methyl<br>237 ppmw ethyl | 65<br>MMSCFD | 6 ppmw methyl<br>35 ppmw ethyl |
| Adjusted | 50 | 200 | 150,000 | 111 ppmw methyl<br>237 ppmw ethyl | 65<br>MMSCFD | 6 ppmw methyl<br>2 ppmw ethyl |
| Adjusted | 50 | 200 | 150,000 | 111 ppmw methyl<br>237 ppmw ethyl | 43<br>MMSCFD | 6 ppmw methyl<br>35 ppmw ethyl |
| Adjusted | 50 | 200 | 150,000 | 252 ppmw methyl<br>326 ppmw ethyl | 43<br>MMSCFD | 8 ppmw methyl<br>35 ppmw ethyl |

EXAMPLE 2

Using the parameters of Example 1, the inlet concentration of methyl mercaptan was varied up to 252 ppmw and ethyl mercaptan up to 326 ppmw to evaluate the impact of the simulation method used to estimate the mercaptan content of the hydrocarbon (crude) feed stream. For the same stripping gas rate, the stripped hydrocarbon stream (product) concentrations were virtually unchanged (methyl mercaptan concentration rose by 2 ppmw; ethyl mercaptan concentration was unchanged). Although not simulated, it is expected that there is a point where the higher inlet concentrations would become a significant factor such that increased stripping gas rates would be needed and potentially at some yet higher inlet concentration that the necessary increase in the stripping gas rate could result in lost column or tower efficiency.

ADDITIONAL EXAMPLES

The sensitivity of the stripping gas rate in the modeling simulation was measured to various assumptions. The results are given in Table II using the adjusted Kij values.

TABLE II

Stripping Gas Rate Sensitivity to Assumptions*

| | Low | High | Units |
|---|---|---|---|
| Impact of inlet mercaptan interaction parameters | 41<br>1.2 | 65<br>1.8 | MMSCFD<br>$\times 10^6$ $m^3$/day |
| Impact of inlet oil concentration doubling | 41<br>1.2 | 46.5<br>1.3 | MMSCFD<br>$\times 10^6$ $m^3$/day |
| Impact of less effective mercaptan recovery at gas treating (lower mercaptan in the stripping gas) | 41<br>1.2 | 41<br>1.2 | MMSCFD<br>$\times 10^6$ $m^3$/day |
| Impact of $CH_3SH$ to $C_2H_5SH$ ratio (cut $CH_3SH$ in half, add as $C_2H_5SH$) | 41<br>1.2 | 44.5<br>1.3 | MMSCFD<br>$\times 10^6$ $m^3$/day |

*The sensitivities simulated used adjusted Kij values.

As noted, the methods and system herein for removing S.C.C. from hydrocarbon streams have an absence of caustic alkali/compounds (e.g. alkali metal hydroxides such as NaOH). There is also an absence of amine compounds and an absence of catalysts in the initial gas stripping of the hydrocarbon stream.

Further, it will be appreciated that in another non-limiting embodiment, the stripping gas stream may contain hydrogen. It will be appreciated that the method herein for stripping S.C.C. from hydrocarbon streams is a non-reacting system, that is, does not involve chemical reaction. Thus, a gas stream that contains hydrogen as a minor component, or even as a major component (greater than 50 volume %) could be employed in the method herein. In one non-limiting embodiment of the invention, the stripping method herein involves an absence of hydrogenation as a means of removing the S.C.C. However, as described caustic or alkali compounds, amine compounds and associated catalysts may optionally be used to remove the S.C.C. from the stripping gas stream subsequently to help in regenerating that stream, i.e. to sweeten it.

The processes and apparatus herein may be applied to hydrocarbon streams and particularly crude oils in many parts of the world. Economic comparison of the additional power required for compression, fuel use and solvent losses may be made against the capital and operating expenses of the other available processes for removing mercaptans from crude oil. Given the high rate of circulation of the stripping gas, the need for substantial gas compression horsepower would be expected. In geographic areas where crude oil is produced with no available gas market, the systems and processes herein may have substantial economic advantage over the existing processes due to relatively low capital requirements and relative low fuel value. In non-limiting embodiments, the more attractive solvents to use may be SELEXOL physical solvent alone or in combination with others such as SULFINOL physical solvent.

Advantages to the gas stripping method and apparatus herein may include one or more of the following, among others yet to be determined.

- The hydrocarbon stream or crude oil is essentially left in a virgin state, thus there is no negative impact to downstream refiners.
- The physical solvents expected to be used are non-aqueous, thus freezing and survivability concerns are reduced.
- The use of mixed solvent systems employing solvents such as SULFINOL or LE-701 from Dow/Union Carbide, in non-limiting embodiments, permits the use of refrigeration systems to remove liquids from the stripping gas.
- The equipment employed is similar to typical oilfield equipment, e.g. compressors, pumps, contactors, strippers, etc. that are already familiar. Generally there would be no additional equipment needed, simply the size of the equipment would need adjustment.
- Major chemical hauling and disposal concerns are avoided due to the absence of a alkali/caustic process.

In the foregoing specification, the methods and compositions have been described with reference to specific embodiments thereof, and have been suggested as effective in providing effective methods and compositions for removing S.C.C. from hydrocarbon streams. It will be evident that various modifications and changes can be made thereto without departing from the broader spirit or scope as set forth in the appended claims. Accordingly, the specification is to be regarded in an illustrative rather than a restrictive sense. For example, specific combinations of hydrocarbon streams, gas stripping streams, solvents, etc., and flow rates thereof, falling within the claimed parameters, but not specifically identified or tried in a particular system to improve S.C.C. and $CO_2$. concentrations in product streams herein, are anticipated to be within the scope of this invention. Additionally, the methods and compositions of this invention may find utility in other applications besides removing S.C.C. from crude oil streams, such as removing S.C.C.(s) from natural gas condensates.

What is claimed is:

1. A method for reducing sulfur containing compounds and specifically the mercaptan content of a mercaptan containing crude oil stream where the method for reducing the mercaptan content of the crude oil stream consisting essentially of stripping the mercaptan containing crude oil stream with a gas stream having a relatively reduced level of mercaptans to produce a gas stream containing an increased level of mercaptans and a crude oil stream containing a reduced level of mercaptans in a non-reactive system, and wherein the method involves an absence of hydrogenation as a means of removing sulfur containing compounds from the crude oil stream.

2. The method of claim 1 where the gas stream strips the mercaptans from the mercaptan containing crude oil stream at a high rate where the high rate is between about 0.1 to about 1.0 MSCF per barrel of crude oil (about 18 to about 180 $m^3$ gas/$m^3$).

3. The method of claim 1 where the total amount of sulfur-containing components in the crude oil stream is reduced to a level of about 40 ppmw or below.

4. The method of claim 1 where the stripping is conducted in a tower where the hydrocarbon stream is introduced at or near the top of the tower, the gas stream is introduced at or near the bottom of the tower, the gas containing sulfur-containing components is removed at or near the top of the tower and the hydrocarbon stream containing reduced level of sulfur-containing component is removed at or near the bottom of the tower.

5. The method of claim 1 further comprising separating liquid from the gas stream containing an increased level of sulfur-containing components and contacting the resulting gas stream with a solvent to remove at least a portion of the sulfur-containing components therefrom.

6. The method of claim 5 further comprising splitting the resulting gas stream into a relatively higher molecular weight hydrocarbon fraction and a relatively lower molecular weight hydrocarbon fraction.

7. The method of claim 1 wherein the stripping is conducted by a technique selected from the group consisting of cocurrent contact, countercurrent contact, cross-current contact and combinations thereof.

8. The method of claim 1 wherein the stripping is conducted in the presence of packing.

9. The method of claim 1 where the stripping is conducted in the presence of trays.

10. The method of claim 1 wherein the gas stream strips methyl mercaptan, ethyl mercaptan and mixtures thereof from the crude oil stream.

11. The method of claim 10 where the gas stream is sweet natural gas.

12. The method of claim 2 where the gas stream rate is at least about 0.25 MSCF per barrel of crude oil (about 44 $m^3$ gas/$m^3$ crude oil).

13. The method of claim 12 where the gas stream rate is at least about 0.3 MSCF per barrel of crude oil (about 53 $m^3$ gas/$m^3$ crude oil).

14. The method of claim 1 where the crude oil stream is heated to a temperature no higher than about 350° F. for the stripping.

15. A method for reducing the sulfur containing compounds and specifically the mercaptan content of a mercaptan containing crude oil stream where the method for reducing the mercaptan content of the crude oil stream consists essentially of stripping the mercaptan containing crude oil stream with a gas stream having a relatively reduced level of mercaptans to produce a gas stream containing an increased level of mercaptans and a crude oil stream containing a reduced level of mercaptans in a non-reactive system, and wherein the method involves an absence of hydrogenation as a means of removing sulfur containing compounds from the crude oil stream, wherein the gas stream strips methyl mercaptan, ethyl mercaptan and mixtures thereof from the crude oil stream, and wherein the gas stream strips the mercaptans from the mercaptan containing crude oil stream at a high rate where the high rate is between about 0.1 to about 1.0 MSCF per barrel of crude oil (about 18 to about 180 $m^3$ gas/$m^3$).

16. The method of claim 15 where the crude oil stream is heated to a temperature no higher than about 350° F. for the stripping.

17. The method of claim 15 further including separating liquid from the gas stream containing an increased level of sulfur-containing components and contacting the resulting gas stream with a solvent to remove at least a portion of the sulfur-containing components therefrom.

* * * * *